US011828254B2

(12) United States Patent
Joyce et al.

(10) Patent No.: US 11,828,254 B2
(45) Date of Patent: Nov. 28, 2023

(54) COMMON RAIL SYSTEM

(71) Applicant: DELPHI TECHNOLOGIES IP LIMITED, St. Michael (BB)

(72) Inventors: Ronan B. Joyce, Canterbury (GB); Lloyd J. Procter, Faversham (GB); Bahadar S. Fashion, Gillingham (GB)

(73) Assignee: DELPHI TECHNOLOGIES IP LIMITED, St. Michael (BB)

( * ) Notice: Subject to any disclaimer, the term of this patent is extended or adjusted under 35 U.S.C. 154(b) by 0 days.

(21) Appl. No.: 17/622,944

(22) PCT Filed: Jun. 26, 2020

(86) PCT No.: PCT/EP2020/068161
§ 371 (c)(1),
(2) Date: Dec. 27, 2021

(87) PCT Pub. No.: WO2020/260667
PCT Pub. Date: Dec. 30, 2020

(65) Prior Publication Data

US 2022/0268245 A1 Aug. 25, 2022

(30) Foreign Application Priority Data

Jun. 27, 2019 (GB) ..... 1909256

(51) Int. Cl.
*F02M 55/02* (2006.01)
*F02M 59/48* (2006.01)
(Continued)

(52) U.S. Cl.
CPC ..... *F02M 55/025* (2013.01); *F02M 37/32* (2019.01); *F02M 59/48* (2013.01); *F02M 61/165* (2013.01); *F02M 2200/27* (2013.01)

(58) Field of Classification Search
CPC .. F02M 55/025; F02M 59/48; F02M 2200/27; F02M 61/165; F02M 37/32
(Continued)

(56) References Cited

U.S. PATENT DOCUMENTS

| | | | |
|---|---|---|---|
| 9,458,808 | B1 | 10/2016 | Torgerud |
| 2004/0069704 | A1 | 4/2004 | Yamaguchi et al. |
| 2009/0095257 | A1 | 4/2009 | Buchhauser et al. |

FOREIGN PATENT DOCUMENTS

| | | | |
|---|---|---|---|
| CN | 1480639 | A | 3/2004 |
| CN | 201539309 | U | 8/2010 |

(Continued)

OTHER PUBLICATIONS

Machine assisted English translation of WO2004090321A1 obtained from https://patents.google.com/patent on Dec. 27, 2021, 4 pages.

(Continued)

*Primary Examiner* — Mahmoud Gimie
(74) *Attorney, Agent, or Firm* — WARNER NORCROSS + JUDD LLP

(57) ABSTRACT

A common rail system for a fuel injection system of an internal combustion engine, the common rail system comprising: a high pressure pump for receiving fuel from a fuel tank; at least one fuel injector for delivering fuel to the internal combustion engine; a common rail for receiving fuel from the high pressure pump through a flow path of the common rail system that connects the high pressure pump to the common rail, the common rail comprising a fuel reservoir in fluid communication with a common rail inlet and in fluid communication with the one or more fuel injectors; and a filter provided in the flow path. The filter is configured to filter fuel so as to prevent particulate matter from entering the common rail. The common rail system comprises only one filter.

8 Claims, 2 Drawing Sheets

(51) Int. Cl.
*F02M 61/16* (2006.01)
*F02M 37/32* (2019.01)

(58) Field of Classification Search
USPC ..... 123/456
See application file for complete search history.

(56) References Cited

FOREIGN PATENT DOCUMENTS

| | | | | | |
|---|---|---|---|---|---|
| DE | 3536814 | A1 | | 1/1987 | |
| DE | 10310818 | A1 | * | 11/2003 | ..... B01D 36/003 |
| DE | 102006047556 | A1 | | 4/2008 | |
| DE | 102006047557 | A1 | * | 4/2008 | ..... F02M 37/22 |
| DE | 102007058238 | A1 | | 6/2009 | |
| DE | 102013100415 | A1 | * | 7/2013 | ..... B01D 36/006 |
| EP | 1063420 | A2 | | 12/2020 | |
| JP | S63176654 | A | | 7/1988 | |
| JP | H07286566 | A | | 10/1995 | |
| JP | 2018178973 | A | | 11/2018 | |
| WO | 2004090321 | A1 | | 10/2004 | |
| WO | 2017103204 | A1 | | 6/2017 | |

OTHER PUBLICATIONS

Machine assisted English translation of JP2018178973A obtained from https://patents.google.com/patent on Dec. 27, 2021, 7 pages.
Machine assisted English translation of JPH07286566A obtained from https://patents.google.com/patent on Dec. 27, 2021, 12 pages.
Machine assisted English translation of CN201539309U obtained from https://patents.google.com/patent on Dec. 27, 2021, 6 pages.
Machine assisted English translation of JPS63176654A obtained from https://worldwide.espacenet.com/?locale=en_EP on Dec. 27, 2021, 2 pages.
Machine assisted English translation of DE3536814A1 obtained from https://patents.google.com/patent on Dec. 27, 2021, 4 pages.
Machine assisted English translation of DE102007058238A1 obtained from https://patents.google.com/patent on Dec. 27, 2021, 4 pages.
Machine assisted English translation of WO2017103204 obtained from https://patents.google.com/patent on Dec. 27, 2021, 7 pages.
Machine assisted English translation of DE102006047556A1 obtained from https://patents.google.com/patent on Dec. 27, 2021, 4 pages.
International Search Report for PCT/EP2020/068161 dated Sep. 18, 2020, 4 pages.
First Notification of Office Action (with translation) issued by the China National Intellectual Property Administration in application No. 202080046634.4 dated Mar. 25, 2023 (16 pages).

* cited by examiner

COMMON RAIL SYSTEM

FIELD OF THE INVENTION

This invention relates to a common rail system for supplying fuel to an internal combustion engine. In particular, but not exclusively, the invention relates to a common rail fuel system for a compression ignition (diesel) fuel injection system.

BACKGROUND

In common rail injection systems, fuel for injection into the internal combustion engine is stored in a central high pressure fuel reservoir known as a common rail. Fuel is supplied to the common rail from a fuel tank by means of a high pressure pump which is supplied with fuel from a low pressure supply pump (transfer pump). The low pressure supply pump delivers fuel from the fuel tank to the high pressure pump, and the high pressure pump pressurizes this fuel and delivers it to the common rail via a high pressure supply line. When required, fuel injectors coupled to the common rail deliver atomised fuel to the engine.

It is known to filter fuel on entry into the injectors from the common rail, so as to guard against damage to the injectors caused by debris generated upstream in the system. It is important to prevent damage being caused to the injectors, and other components of the fuel injection system, to ensure continued high performance and to prolong service life.

It is against this background that the invention has been devised.

SUMMARY OF THE INVENTION

According to the present invention, there is provided a common rail system for a fuel injection system of an internal combustion engine. The common rail system comprises a high pressure pump for receiving fuel from a fuel tank. The common rail system comprises at least one fuel injector for delivering fuel to the internal combustion engine. The common rail system comprises a common rail for receiving fuel from the high pressure fuel pump through a flow path of the common rail system that connects the high pressure pump to the common rail.

The common rail comprises a fuel reservoir in fluid communication with a common rail inlet and in fluid communication with the one or more fuel injectors. The common rail system comprises a filter provided in the flow path that connects the high pressure pump to the common rail, and configured to filter fuel so as to prevent particulate matter from entering the common rail. The common rail system comprises only one filter.

For the avoidance of doubt, the flow path between the high pressure pump and the common rail therefore comprises the outlet from the high pressure pump and the common rail inlet.

The filter may be provided at the common rail inlet. Alternatively, the filter may be provided at an outlet of the high pressure pump.

Filtering the fuel at the high pressure pump or at the inlet to the common rail, i.e. before it enters the common rail, prevents particles or debris above a certain size from reaching the high pressure fuel reservoir. Particulate matter contained in the fuel, which may originate in the fuel tank, the high pressure pump, or connecting lines between components of the system, can cause blockages, a reduction in useful lifetime, and failure of components of the common rail. The invention allows for a single filter to protect not only the components of and associated with the common rail, but also the fuel injectors.

Including no more than one filter, i.e. a single filter, in the system provides a cost benefit over standard systems that require one filter per fuel injector to be used. The assembly process is also simplified if only one filter is required, as opposed to having to fit multiple filters into the system, one per injector.

The filter may comprise a generally cylindrical first portion having a first diameter and a generally cylindrical second portion having a second diameter. The second diameter may be smaller than the first diameter. The first portion may define an inlet flow path to the filter.

A wall of the second portion may comprise a plurality of openings to define an outlet flow path from the filter.

When the filter is provided at the inlet to the common rail, the openings may be sized and dimensioned to dampen pressure pulsations in the system. That is, the filter may be configured to essentially replicate the effect of a standard inlet jet orifice, and perform a similar level of damping or attenuation of pressure pulsations caused by injection of fuel into the common rail. Thus, the function of the inlet orifice of known systems can be maintained by the filter of the invention.

At least one opening may be a generally cylindrical drilling through the wall of the filter. The at least one opening may have a diameter in the range of, for example, 50 to 100 microns. At least one opening may be a tapered drilling through the wall of the filter.

The openings may extend over a length, $L_0$, of the second portion of the filter, wherein the length, $L_0$, forms between 50% and 80% of a total length, $L_T$, of the second portion of the filter. As the skilled person will understand, the percentage of the total length, $L_T$, over which the openings extend may vary depending on, for example, the size of the filter. The size of the filter may in turn depend on the application in which the filter/common rail system is to be used.

A longitudinal axis of each opening may extend in a plane that is substantially perpendicular to the direction of fuel flow through the inlet flow path to the filter.

The cross sectional flow area of each of the openings may be substantially the same for all openings.

The filter may be provided or positioned in a chamber of the common rail inlet, and the first portion of the filter may engage an inner surface of the chamber such that the filter is retained in the chamber via a push-fit or press-fit. The filter may form an integral part of the common rail inlet.

Alternatively, the filter may be provided or positioned in a chamber of the high pressure pump outlet, and the first portion of the filter may engage an inner surface of the chamber such that the filter is retained in the chamber via a push-fit or press-fit. The skilled person will understand that different tooling and techniques may be required to install the filter at the outlet of the high pressure pump instead of at the inlet of the common rail. This is, at least in part, because the filter is inserted into the high pressure pump outlet in a different orientation to that which it is inserted into the inlet of the common rail during assembly. The first portion of the filter is received in the outlet of the high pressure pump before the second portion when assembling the filter in the high pressure pump outlet. In contrast, the second portion of the filter is received in the inlet of the common rail before the first portion when assembling the filter in common rail inlet. The skilled person would understand that this difference in orientation on insertion into the inlet/outlet may require the use of different tooling and/or techniques for assembly.

As an alternative to providing the filter as a separate part that is inserted in a push or press-fit during assembly, the filter may form an integral part of the pump outlet.

BRIEF DESCRIPTION OF THE DRAWINGS

In order that the invention may be more readily understood, preferred non-limiting embodiments thereof will now be described, by way of example only, with reference to the accompanying drawings, in which.

Figure 1:
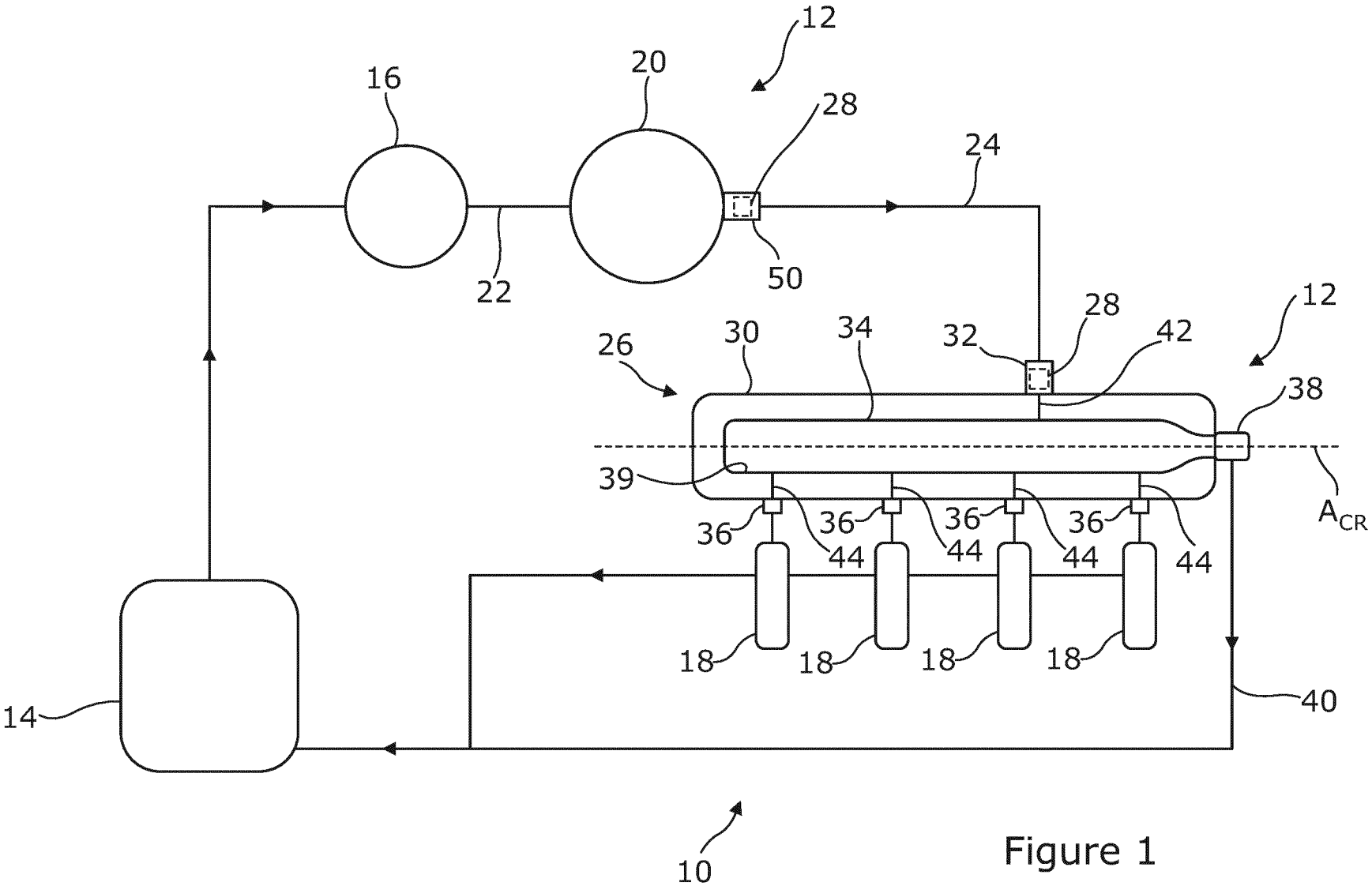
FIG. 1 is a schematic view of a fuel injection system comprising a common rail system in accordance with the invention.

In the drawings, as well as in the following description, like features are assigned like reference signs.

SPECIFIC DESCRIPTION

FIG. 1 shows a fuel injection system 10 for an internal combustion engine (not shown). The fuel injection system 10 includes a common rail system 12 in accordance with the invention, a fuel tank 14 and a fuel supply pump 16. The common rail system 12 includes a plurality of fuel injectors 18 for delivering fuel to the internal combustion engine.

In use, fuel is delivered from the fuel tank 14 to the engine by the fuel injection system 10. The fuel supply pump 16, also known as a lift pump (transfer pump), draws fuel from the fuel tank 14 where it is stored at low pressure, and delivers this fuel to a high pressure pump 20 via a low pressure supply line 22. The high pressure pump 20 pressurises and delivers this fuel via a high pressure supply line 24 to a common rail 26, in which the pressurised fuel is stored. When required, fuel from the common rail 26 is delivered to the engine via the injectors 18 in a well-known manner.

The common rail system 12 includes the common rail 26, the high pressure pump 20, the fuel injectors 18, and a single filter 28 provided in a flow path that connects the high pressure pump 20 to the common rail 26.

The filter 28 is shown in the schematic of FIG. 1 in two of the possible positions at which it may be provided in the common rail system 12: an inlet 32 of the common rail 26 and an outlet 50 of the high pressure pump 20. It should be noted that these two locations are alternatives for the placement of the filter 28, as indicated by the use of dashed lines to denote the filter 28 in FIG. 1. A common rail system in accordance with the invention must only include one filter 28, and therefore could not include filters 28 at each of these locations.

It should also be noted that the filter 28 is not limited to the positions illustrated in FIG. 1, but could be provided anywhere in the flow path connecting the high pressure pump 20 to the common rail 26, so long as only one filter 28 is provided in the common rail system 12. Thus, in the embodiment of the system illustrated in FIG. 1, the filter could equally be provided at some other position within and along the high pressure supply line 24.

The common rail 26 comprises a housing 30, the common rail inlet 32 for receiving fuel from the high pressure pump 20, a fuel reservoir 34 for storing high pressure fuel, and a plurality of outlets 36 for supplying the injectors 18 with high pressure fuel from the fuel reservoir 34. The common rail system 12 also includes one or more rail pressure sensors (not shown) for monitoring the pressure in the common rail 26, and a pressure limiting valve 38, or PLV 38, for controlling pressure in the common rail 26. Specifically, the PLV 38 is configured to release fuel from the fuel reservoir 34 when the rail pressure sensors detect that the pressure in the common rail 26 has reached a certain pre-defined threshold value. In this way, pressure in the common rail 26 is relieved. As illustrated in FIG. 1, fuel exiting the common rail 26 through the PLV 38 is directed back to the fuel tank 14 via a return line 40.

The fuel reservoir 34 comprises a substantially tubular bore 39 formed in the housing 30 of the common rail 26, and extending substantially along a longitudinal axis, $A_{CR}$, of the common rail 26. The fuel reservoir 34 is coupled to the common rail inlet 32 by means of a reservoir supply passage 42 formed in the housing 30 of the common rail 26, and is coupled to each of the outlets 36 by means of separate outlet supply passages 44 also formed in the common rail housing 30. In this way, the inlet 32 and outlets 36 of the common rail 26 are each in fluid communication with the fuel reservoir 34. The common rail inlet 32 is coupled to the high pressure pump 20 by means of the high pressure supply line 22. Each common rail outlet 36 is coupled to a respective injector 18 by an injector supply line 46.

Figure 2:
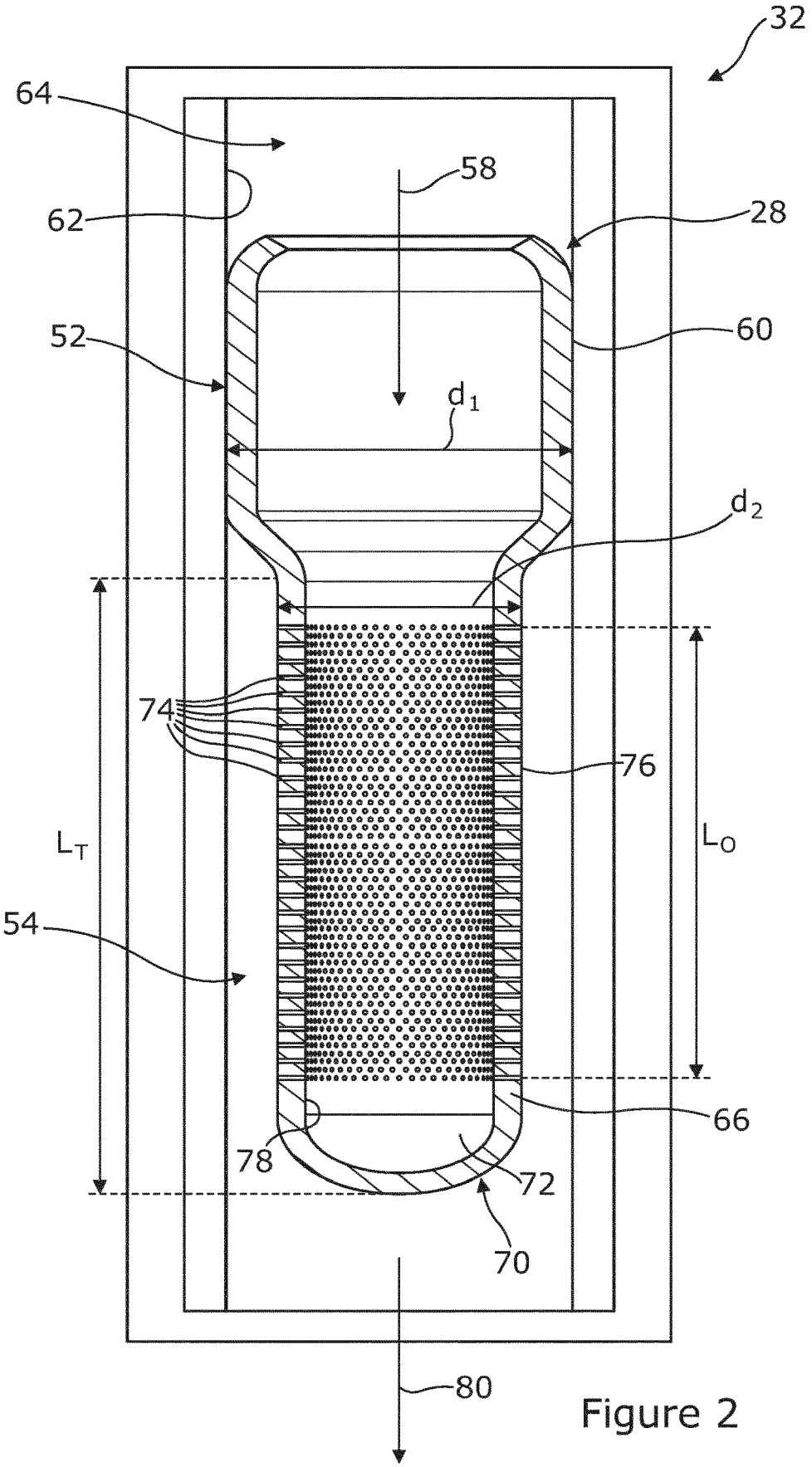
FIG. 2 is a cross sectional view of a filter positioned in an inlet of the common rail system of FIG. 1.

FIG. 2 shows the filter 28 provided at the inlet 32 of the common rail 26 in an embodiment of the invention.

As already explained, in other embodiments the filter 28 may be provided elsewhere in the common rail system 12, but in all embodiments the common rail system 12 comprises no more than one filter.

This filter 28 is provided upstream of the injectors 18 and the fuel reservoir 34, specifically in the flow path that connects the common rail 26 and the high pressure pump 20.

By incorporating the filter 28 in this way, the invention advantageously removes the need to include multiple injection filters in the system 12. Instead of including separate filters 28 for each injector 18, the invention uses a single filter 28 positioned upstream of the fuel reservoir 34. This not only prevents debris, or particulate matter, in the fuel from entering and damaging the injectors 18, but has the further benefit of preventing this debris from entering and damaging components of, and associated with, the common rail 26. In this way, the useful lifetime of components of the common rail system 12 is increased, and the likelihood of damage and failure is reduced. Furthermore, including just a single filter 28 in the system 12 provides a cost benefit when compared to systems incorporating multiple filters 28.

Referring again to FIG. 2, the filter 28 comprises a first portion 52 and a second portion 54, each of which are generally cylindrical in shape. The first portion 52 has a first diameter, $d_1$, and the second portion 54 has a second diameter, $d_2$. The first diameter, $d_1$, is the maximum outer diameter of the first portion 52, where the outer diameter is the diameter defined by an outer surface 56 of the filter 28. Correspondingly, the second diameter, $d_2$, is the maximum outer diameter of the second portion 54. As illustrated in FIG. 2, the second diameter, $d_2$, is smaller than the first diameter, $d_1$.

The first portion 52 defines an inlet flow path 58 to the filter 28, which receives fuel supplied to the common rail 26 by the high pressure pump 20. The first portion 52 is dimensioned such that an outer surface 60 of the first portion 52 engages with an inner wall 62 of an inlet chamber 64 of the inlet 32. In this way, the filter 28 is retained in the inlet chamber 64 in a press-fit or push-fit. It should be noted that, in other embodiments of the invention, the filter 28 may be formed integrally with the inlet 32 rather than being provided as a separate part. That is, in some embodiments the filter 28 may be machined directly into the inlet 32.

The second portion 54 comprises a wall 66 that defines an outlet flow path from the filter 28, and a closed tip region 70 that defines an accumulation portion 72 of the filter 28. In use, solid debris or particulate matter accumulates in the accumulation portion 72.

The outlet flow path is defined by a plurality of openings 74 that are drilled through the wall 66 of the second portion 54 of the filter 28. It should be noted that, for clarity, not all of these openings are labelled in FIG. 2. One or more of the number, size, shape, dimensions and layout of the openings 74 is selected so as to provide dampening of any pressure pulsations that may occur within the fuel in the common rail 26, for example as a result of the injection process. The configuration and arrangement of these openings 74 is chosen to provide a dampening effect that is similar to that provided by inlet jet orifices utilised in known common rail systems. In this way, the filter 28 provides both a filtering function for the fuel entering the common rail 26, and a dampening or attenuation function for pressure pulsations generated in the system 12 in this embodiment of the invention. As the skilled person would understand, such dampening is not required at the outlet 50 of the high pressure pump 20. Thus, in embodiments in which the filter 28 is provided at the high pressure pump outlet 50, the openings 74 are not arranged to provide a dampening function, but are only configured to provide optimal flow through the filter 28.

In the embodiment shown in FIG. 2, the second portion 54 comprises 5000 openings 74. However, more of fewer openings 74 may be included in other embodiments of the invention. In particular, the second portion may comprise between 200 and 5000 openings.

Each opening 74 may be formed by a generally cylindrical drilling. Typically the diameter of each opening is between 50 μm and 100 μm.

In other embodiments, such as that shown in FIG. 2, the openings 74 in the wall 66 of the second portion 54 of the filter 28 are not cylindrical along the full length of the opening 74, but taper inwardly from an outer surface 76 of the wall 66 to an inner surface 78 of the wall 66. Such conical openings 74 improve flow of fuel through the filter 28. In this embodiment of FIG. 2, the minimum diameter of each opening 74, i.e. the diameter of each opening at the inner surface 78, is 50 μm. The maximum diameter of each opening 74, i.e. the diameter of each opening 74 at the outer surface 76, is 100 μm. In other embodiments, these minimum and maximum diameters may vary in the range between 30 μm to 150 μm.

It should be noted that whilst each opening 74 is identical in the embodiment illustrated in FIG. 2, this is not a requirement of the invention. Some embodiments may incorporate one or more openings 74 having different sizes and/or shapes than one or more of the other openings 74. For example, the cross sectional flow area, and how it varies along the length of each opening, is typically the same for all openings, although in other embodiments different openings may have a different cross sectional flow area.

A longitudinal axis of each opening 74 extends in a plane that is substantially perpendicular to the direction of fuel flow along the inlet flow path 58. In other embodiments, the angle between the direction of flow along the inlet flow path 58 and the plane containing the direction of the longitudinal axis of each opening may vary from perpendicular.

The openings 74 extend over a length, $L_0$, of the second portion 54 of the filter 28. The length, $L_0$, forms 75% of a total length, $L_T$, of the second portion 54 of the filter 28 in this embodiment. However, in other embodiments this length, $L_0$, may vary between 50% and 80% of the total length, $L_T$.

During operation, pressurized fuel is supplied to the common rail 26 from the high pressure pump 20 via the high pressure supply line 24 through the flow path which connects the high pressure pump 20 to the common rail 26, and which includes the high pressure pump outlet 50, the common rail inlet 32 and the high pressure supply line 24. Pressurised fuel enters the inlet 32 of the common rail 26, and enters the filter 28 provided in the inlet chamber 64.

In the first portion 52 of the filter 28, the fuel flows along the inlet flow path 58. In the second portion 54 of the filter 28, any solid material contained in the fuel accumulates and settles in the tip region 70 due to its weight, and filtered fuel flows through the openings 74, changing flow direction to exit through the openings, and flows out along the outlet flow path. As described already, the openings 74 are oriented at approximately 90 degrees to the direction of flow along the inlet flow path 58.

On exiting the filter 28, the filtered fuel continues on through the inlet chamber 64 in a direction parallel to the direction of flow along the inlet flow path 58, as indicated by arrow 80, and is delivered to the fuel reservoir 34 by means of the reservoir supply passage 42. This fuel is then stored in the fuel reservoir 34 from where it is delivered to the injectors of the engine.

Incorporating a single filter 28 upstream of the fuel reservoir 34 in this way provides a number of advantages to the system 12.

Filtering the fuel before it enters the common rail 26 prevents particles or debris above a certain size from reaching not only the injectors 18, but also other components of, and associated with, the common rail 26, such as the PLV 38. This provides an advantage over standard arrangements in which fuel from the high pressure pump 20 enters the common rail 26 without filtering, such that the common rail 26 and associated components may be exposed to fuel carrying debris or particulate matter which may cause damage. In this scenario, debris can cause blockages, a reduction in useful lifetime, and failure of components of the common rail 26.

Including just a single filter 28 in the system 12, rather than one filter 28 per injector 18, also provides a cost benefit. This reduction in cost is obtained whilst still protecting the fuel injectors 18, and whilst additionally protecting components of the common rail 26. Furthermore, the filter 28 may be configured to replicate the effect of existing inlet jet orifices and perform a similar dampening function of pressure pulsations. Thus, the function of the inlet orifice of known systems is maintained by the filter 28 of the invention.

It will be appreciated by a person skilled in the art that the invention could be modified to take many alternative forms to that described herein, without departing from the scope of the appended claims.

REFERENCES USED fuel injection system 10
common rail system 12
fuel tank 14
fuel supply pump 16
fuel injectors 18 high pressure pump 20
low pressure supply line 22
high pressure supply line 24
common rail 26
filter 28
housing 30
common rail inlet 32
fuel reservoir 34
common rail outlet 36
pressure limiting valve 38
tubular bore 39
return line 40
reservoir supply passage 42
outlet supply passages 44
injector supply line 46
high pressure pump inlet 48
high pressure pump outlet 50
first portion of filter 52
second portion of filter 54
outer surface of the filter 56
inlet flow path 58
outer surface of first portion 60
inner wall 62
inlet chamber 64
wall of second portion 66
tip region 70
accumulation portion 72
openings through wall of second portion 74
outer surface of second portion 76
inner surface of second portion 78
direction of fuel flow on exiting filter 80

The invention claimed is:

1. A common rail system for an internal combustion engine, the common rail system comprising:

a high pressure pump for receiving fuel from a fuel tank;

at least one fuel injector for delivering fuel to the internal combustion engine;

a common rail for receiving fuel from the high pressure pump through a flow path of the common rail system that connects the high pressure pump to the common rail, the common rail comprising a fuel reservoir in fluid communication with a common rail inlet and in fluid communication with the one or more fuel injectors; and a filter provided in the flow path and configured to filter fuel so as to prevent particulate matter from entering the common rail, wherein the common rail system comprises only one filter, wherein the flow path comprises the common rail inlet and an outlet of the high pressure pump, and wherein the filter is provided at and inserted into the outlet of the high pressure pump.

2. A common rail system as claimed in claim 1, wherein the filter comprises a generally cylindrical first portion having a first diameter and a generally cylindrical second portion having a second diameter, the second diameter being smaller than the first diameter, and wherein the first portion defines an inlet flow path to the filter.

3. A common rail system as claimed in claim 2, wherein a wall of the second portion comprises a plurality of openings to define an outlet flow path from the filter.

4. A common rail system as claimed in claim 3, wherein at least one opening is a generally cylindrical drilling through the wall of the filter and has a diameter in the range of 50 μm to 100 μm.

5. A common rail system as claimed in claim 3, wherein at least one opening is a tapered drilling through the wall of the filter.

6. A common rail system as claimed in claim 3, wherein the openings extend over a length, $L_O$, of the second portion of the filter, wherein the length, $L_O$, forms between 50% and 80% of a total length, $L_T$, of the second portion of the filter.

7. A common rail system as claimed in claim 3, wherein a longitudinal axis of each opening extends in a plane that is substantially perpendicular to the direction of fuel flow through the inlet flow path to the filter.

8. A common rail system as claimed in claim 3, wherein the cross sectional flow area of each of the openings is substantially the same for all openings.

* * * * *